US005934104A

United States Patent [19]

Fidkowski et al.

[11] Patent Number: 5,934,104

[45] Date of Patent: Aug. 10, 1999

[54] MULTIPLE COLUMN NITROGEN GENERATORS WITH OXYGEN COPRODUCTION

[75] Inventors: Zbigniew Tadeusz Fidkowski, Macungie; Donn Michael Herron, Fogelsville; Jeffrey Alan Hopkins, Whitehall, all of Pa.

[73] Assignee: Air Products and Chemicals, Inc., Allentown, Pa.

[21] Appl. No.: 09/088,993

[22] Filed: Jun. 2, 1998

[51] Int. Cl.[6] ..... F25J 3/04

[52] U.S. Cl. ..... 62/643; 62/646; 62/900

[58] Field of Search ..... 62/643, 645, 646, 62/648, 649, 900

[56] References Cited

U.S. PATENT DOCUMENTS

| | | | |
|---|---|---|---|
| 4,222,756 | 9/1980 | Thorogood . | |
| 4,439,220 | 3/1984 | Olszewski et al. . | |
| 4,448,595 | 5/1984 | Cheung . | |
| 4,453,957 | 6/1984 | Pahade et al. . | |
| 4,560,397 | 12/1985 | Cheung . | |
| 4,604,117 | 8/1986 | Cheung . | |
| 4,617,036 | 10/1986 | Suchdeo . | |
| 4,717,410 | 1/1988 | Grenier . | |
| 4,783,210 | 11/1988 | Ayres et al. . | |
| 4,848,996 | 7/1989 | Thorogood et al. . | |
| 4,927,441 | 5/1990 | Agrawal . | |
| 5,006,137 | 4/1991 | Agrawal et al. . | |
| 5,049,173 | 9/1991 | Cormier, Sr. et al. . | |
| 5,069,699 | 12/1991 | Agrawal . | |
| 5,098,457 | 3/1992 | Cheung et al. . | |
| 5,129,932 | 7/1992 | Agrawal et al. . | |
| 5,231,837 | 8/1993 | Ha | 62/646 |
| 5,245,832 | 9/1993 | Roberts | 62/900 X |
| 5,341,646 | 8/1994 | Agrawal et al. | 62/900 X |
| 5,402,647 | 4/1995 | Bonaquist et al. . | |
| 5,463,871 | 11/1995 | Cheung | 62/646 |
| 5,572,874 | 11/1996 | Rathbone | 62/645 |
| 5,582,035 | 12/1996 | Rathbone et al. | 62/900 X |
| 5,582,036 | 12/1996 | Drnevich et al. | 62/656 |
| 5,664,438 | 9/1997 | Bonaquist et al. | 62/900 X |
| 5,669,236 | 9/1997 | Billingham et al. | 62/643 |
| 5,692,398 | 12/1997 | Higginbotham | 62/648 |
| 5,697,229 | 12/1997 | Agrawal et al. . | |

FOREIGN PATENT DOCUMENTS

| | | | |
|---|---|---|---|
| 0701099 | 3/1996 | European Pat. Off. | F25J 3/04 |
| 2215377 | 12/1970 | United Kingdom | F25J 3/04 |

*Primary Examiner*—Christopher B. Kilner
*Attorney, Agent, or Firm*—Wiiard Jones, II

[57] ABSTRACT

The present invention is an improvement to a nitrogen generator enabling the process to efficiently coproduce oxygen with low recovery, typically less than 70% and preferably less than 55%, in addition to the primary product, nitrogen. In the nitrogen generator process, air is distilled in a distillation column system having a higher pressure column and a lower pressure column. The feed air is compressed, treated to remove water and carbon dioxide, cooled to near its dew point and fed to the higher pressure column of the distillation column system. The nitrogen product is produced by removing an overhead vapor stream from at least one of the columns of the distillation column system. At least one oxygen-enriched stream is removed from the lower pressure column. The improvement is characterized in that: (a) the oxygen-enriched stream is removed from the lower pressure column at a location that is at or below the feed to the lower pressure column; (b) feeding the removed oxygen-enriched stream to a supplemental distillation column for separation into an oxygen bottoms and a waste overhead; (c) providing boilup to the supplemental distillation column and (d) removing an oxygen stream (vapor or liquid) from the bottom of the supplemental distillation column as an oxygen product.

15 Claims, 11 Drawing Sheets

FIGURE 6 - PRIOR ART

MULTIPLE COLUMN NITROGEN GENERATORS WITH OXYGEN COPRODUCTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a cryogenic process to produce nitrogen at elevated pressure and oxygen, where nitrogen recovery is high, typically greater than 70%, preferably greater than 85%, and oxygen recovery is significantly less than 100%, typically less than 70% and preferably less than 55%. In certain industrial applications, i.e., the electronics or petrochemical industry, there is a need for nitrogen and, sometimes, a small amount of oxygen. The complete separation of nitrogen and oxygen from an air feed (from a full recovery plant) would be highly inefficient when there is no market for the produced oxygen in excess of the required oxygen. Therefore, there is a need for an efficient air separation plant with a high nitrogen recovery and a relatively low oxygen recovery.

There are several processes in the art for the production of nitrogen, but very few relate to processes where small quantities of oxygen are simultaneously coproduced.

Nitrogen generators may consist of one, two or more distillation columns. The improvement of the present invention relates to nitrogen generators consisting of two or more columns.

In a double column nitrogen generator, each of the columns can be a full size distillation column or it can be reduced to a smaller fractionator containing as few as one fractionation stage (in addition to a reboiler or condenser, if applicable).

U.S. Pat. No. 4,604,117 teaches a cycle consisting of a single column with a prefractionator that creates new feeds (of different compositions) to the main column.

U.S. Pat. Nos. 4,848,996 and 4,927,441 each teach a nitrogen generator cycle with a post-fractionator. The post-fractionator, which is thermally integrated with the top of the rectifier, separates oxygen-enriched bottom liquid into even an more oxygen-enriched fluid and a vapor stream with a composition similar to air. This "synthetic air" stream is then warmed, compressed and recycled back to the rectifier.

U.S. Pat. No. 4,222,756 teaches a classic double column process cycle for nitrogen production. In the classic double column cycle, the objective of the first (higher pressure) column is to separate feed air into a nitrogen overhead vapor and an oxygen-enriched liquid that is subsequently processed in the second column (usually operated at a lower pressure) to further recover nitrogen.

GB Patent 1,215,377 and U.S. Pat. Nos. 4,453,957; 4,439,220; 4,617,036; 5,006,139 and 5,098,457 teach various other embodiment of a double column nitrogen generator. The concepts taught in these patents vary in the means of thermal integration of columns, e.g., using different media in reboilers/condensers and applications of intermediate or side reboilers in the columns. Other differences are in the means of supplying refrigeration to the plant, e.g., by expansion of different media.

U.S. Pat. No. 4,717,410 teaches another double column nitrogen generator process schemes. In this taught generator, the recovery of a high pressure nitrogen product is increased (at the expense of the recovery of the lower pressure nitrogen) by pumping back liquid nitrogen from the lower pressure column to the higher pressure column.

U.S. Pat. Nos. 5,069,699; 5,402,647 and 5,697,229, as well as, EP 0701099 each teach nitrogen generators schemes which contain more than two columns. The additional column or a section of a column is used either to further increase the recovery and/or the pressure of nitrogen product or to provide an ultra high purity nitrogen product.

U.S. Pat. No. 5,129,932 teaches a cryogenic process for the production of moderate pressure nitrogen together with a high recovery of oxygen and argon. The increase in nitrogen pressure, in comparison with the art referenced above, is achieved by expanding a portion of nitrogen from the high pressure column, however, the process is a full recovery cycle.

U.S. Pat. No. 5,049,173 teaches the principle of producing ultra high purity oxygen from any cryogenic air separation plant. In particular, the improvement comprises removing an oxygen-containing but heavy contaminant-free stream from one of the distillation columns and further stripping this stream from light contaminants in a fractionator to produce ultra high purity oxygen. The heavy contaminant-free stream is obtained by withdrawing the stream from a position above the heavy contaminant-containing feed(s).

U.S. Pat. No. 4,448,595 teaches the use of a double column air separation process, where boilup for the lower pressure column is supplied by a portion of a feed air (a "split column"), to produce nitrogen and, optionally, some oxygen. All the oxygen product is produced from the lower pressure column along with at least some of the nitrogen product. The oxygen product is withdrawn from (or near) the bottom of the lower pressure column as liquid and then vaporized at the top of this column. If the purity of the oxygen product is greater than 97%, the patent teaches that the product can be withdrawn from the bottom of the low pressure column. Any excess oxygen may be withdrawn from the lower pressure column in a waste stream. This waste stream contains also nitrogen which reduces significantly nitrogen recovery from this column. The improvement of this patented invention manifests itself in that the lower pressure column operates at elevated pressure, providing nitrogen product at elevated pressure. Therefore, the waste stream contains excess pressure energy and is expanded to provide the necessary refrigeration for the plant. If the refrigeration is provided by other means (e.g., a liquefier), the waste expander is no longer necessary and can be eliminated.

Single column nitrogen generators are not relevant to the process of the present invention, because they are unable to provide a high recovery of nitrogen. Nevertheless, to provide a more complete review of the background art, the patents teaching single column nitrogen generator cycles are provided.

U.S. Pat. Nos. 4,560,397 and 4,783,210 each teach process schemes for the coproduction of oxygen using a single column nitrogen generator.

U.S. Pat. No. 4,560,397 teaches a process for the production of elevated pressure nitrogen, together with ultra high purity oxygen. In this process, a two-column cycle is used, where the first, higher pressure, column is devoted to nitrogen production and the oxygen product is withdrawn from the second, lower pressure, column, at a point above the liquid sump, to avoid heavy impurities.

U.S. Pat. No. 4,783,210 teaches a single column nitrogen generator where an oxygen-enriched liquid from the bottom of the nitrogen generator is partially boiled in a reboiler-condenser on top of the nitrogen generator, resulting in a vapor waste stream, and in a second oxygen-enriched liquid that is eventually purified in an additional column.

BRIEF SUMMARY OF THE INVENTION

The present invention is an improvement to a nitrogen generator enabling the process to efficiently coproduce oxygen with low recovery, typically less than 70% and preferably less than 55%, in addition to the primary product, nitrogen. In the nitrogen generator process, air is distilled in a distillation column system having a higher pressure column and a lower pressure column. The feed air is compressed, treated to remove water and carbon dioxide, cooled to near its dew point and fed to the higher pressure column of the distillation column system. The nitrogen product is produced by removing an overhead vapor stream from at least one of the columns of the distillation column system. At least one oxygen-enriched stream is removed from the lower pressure column. The improvement is characterized in that: (a) the oxygen-enriched stream is removed from the lower pressure column at a location that is at or below the feed to the lower pressure column; (b) feeding the removed oxygen-enriched stream to a supplemental distillation column for separation into an oxygen bottoms and a waste overhead; (c) providing boilup to the supplemental distillation column and (d) removing an oxygen stream (vapor or liquid) from the bottom of the supplemental distillation column as an oxygen product. In the process of the present invention, the boilup for the supplemental distillation column can be provided by condensing a portion of a vapor stream from the higher pressure column; by condensing a portion of a vapor stream from the lower pressure distillation column; by condensing a portion of the feed air or by sensible cooling of at least a portion of an oxygen-enriched liquid removed from the distillation column system.

In the process of the present invention, the ratio of liquid flow to vapor flow in a separation zone of the supplemental distillation column can be controlled by bypassing, around the separation zone, a portion of the liquid or the vapor which would have entered the portion of the separation zone.

In the process of the present invention, process refrigeration can be provided by expanding an oxygen-enriched vapor from the lower pressure distillation column; by expanding the waste overhead from the supplemental distillation column or by expanding at least a portion of the compressed feed air.

In the process, the coproduced oxygen can contain about 85% to about 99.99% of oxygen. Typically, this range will be between 95% to 99.7%. In the preferred embodiment of the invention, the oxygen-enriched feed to the supplemental distillation column is withdrawn as a liquid from the lower pressure column. In the most preferred embodiment, the oxygen-enriched feed to the supplemental distillation column is withdrawn from the bottom of the lower pressure column.

DETAILED DESCRIPTION OF THE INVENTION

The present invention, described in the Summary above, will now be discussed in detail with reference to several specific embodiments. In the following description, the term "oxygen-enriched liquid" means a liquid with oxygen content greater than in the air.

Figure 1:
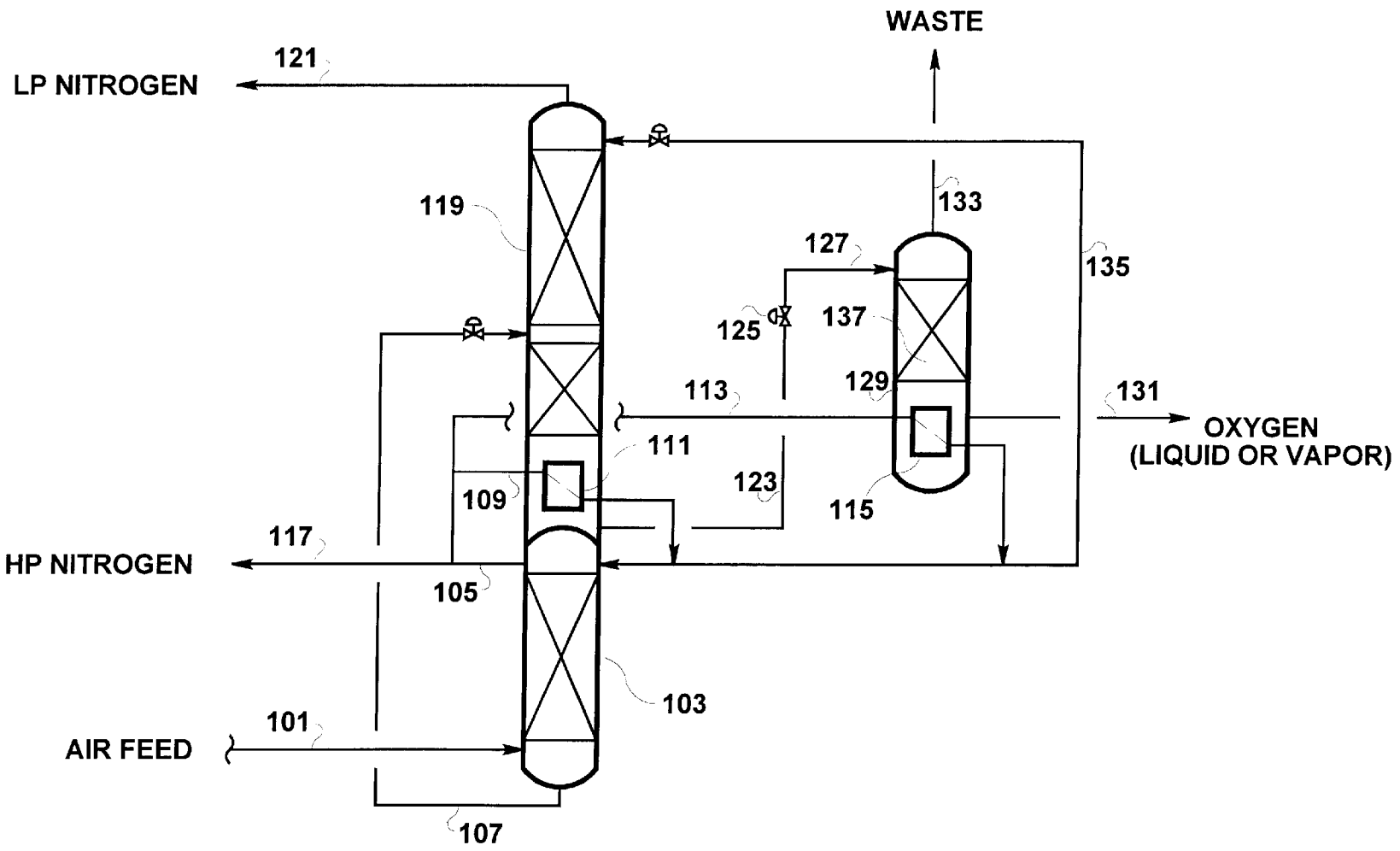
FIGS. 1 through 5 are schematic diagrams of several embodiments of the process of the present invention.

One of the possible embodiments of the present invention is schematically shown in FIG. 1. Cooled feed air 101 enters higher pressure column 103 where it is separated into nitrogen overhead vapor 105 and first oxygen-enriched liquid 107. A portion of nitrogen overhead vapor in line 109 is liquefied in reboiler/condenser 111. A second portion of nitrogen overhead vapor in line 113 is liquefied in supplemental reboiler/condenser 115. Optionally, the third portion of nitrogen overhead vapor in line 117 can be withdrawn as the higher pressure nitrogen product. Liquefied nitrogen 135 provides reflux to lower pressure column 119. First oxygen-enriched liquid 107 is further separated in the lower pressure column 119 into lower pressure nitrogen vapor 121 and second oxygen-enriched liquid 123. Second oxygen-enriched liquid 123 is let down in pressure across valve 125 and the resulting fluid in line 127 is fed to a supplemental distillation column, stripper 129, where it is further separated to produce oxygen product 131 (withdrawn as a liquid or vapor) and the waste stream 133. Since oxygen product 131 is more enriched in oxygen than the second oxygen-enriched liquid 123, then, for the embodiment of FIG. 1, the pressure in stripper 129 must be lower than the pressure in lower pressure column 119. Supplemental column or stripper 129 is composed of the sump with a reboiler/condenser 115 (that could be located inside the shell of the sump or outside the column, but connected with the sump by a liquid and a vapor line) and a mass transfer zone 137, constructed of distillation trays, structured packing or any other suitable mass transfer contacting device.

The use of second oxygen-enriched liquid 123 withdrawn from the bottom of low pressure distillation column 119 as feed to column 129 is preferred. It is understood, however, that the feed to the supplemental distillation column 129 may be any oxygen containing fluid withdrawn from the lower pressure column from a location below the point where the feed is introduced (in this embodiment, stream 107). Furthermore, though not shown in FIG. 1, it is possible to withdraw a third oxygen-enriched stream (from the lower pressure column). For example, one might elect to withdraw a third oxygen-enriched stream as a vapor and, eventually, expand said stream to provide refrigeration for the process.

Figure 2:
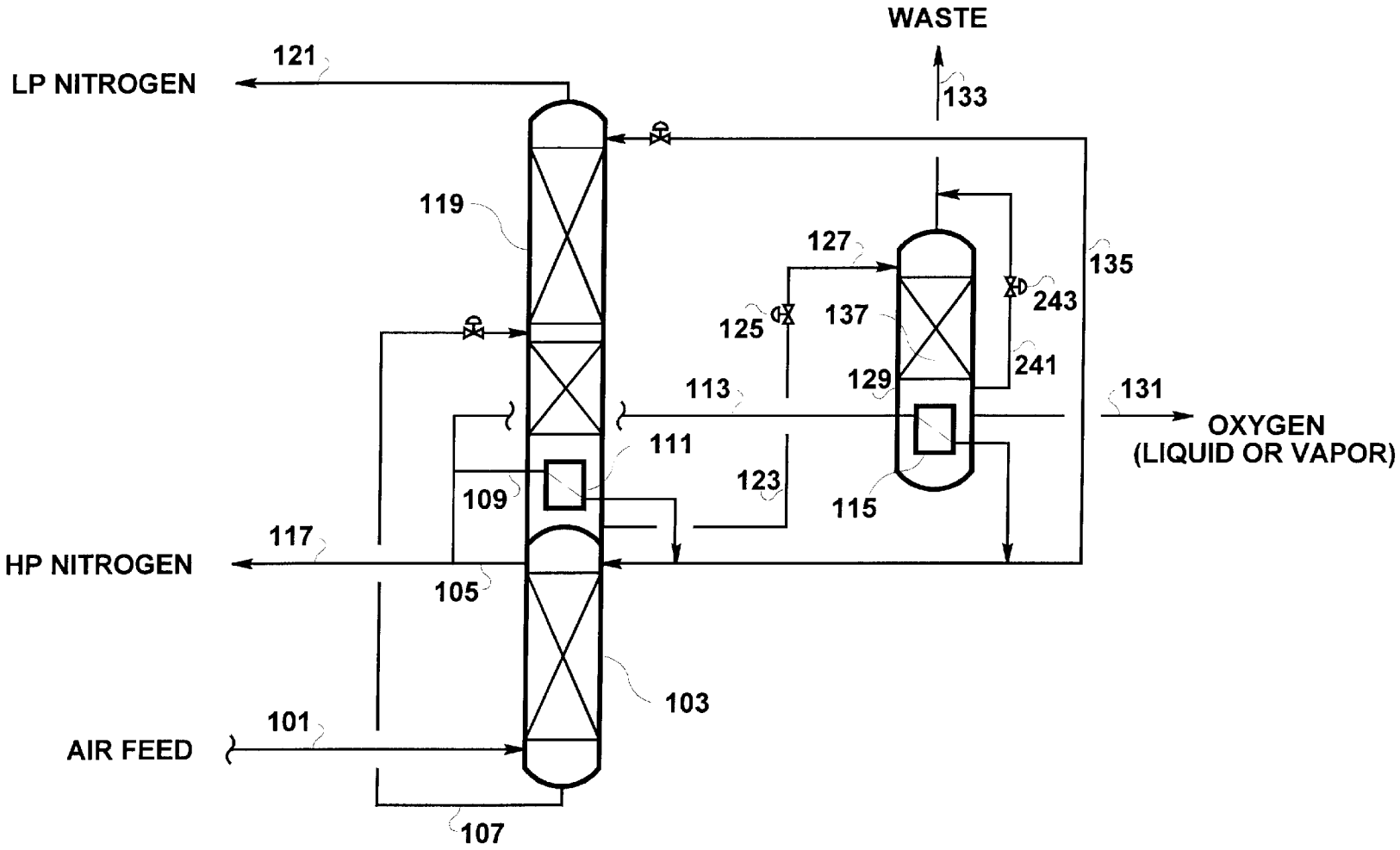

For any given air separation plant the demand for oxygen may change over time. This may affect the ratio of liquid flow to vapor flow in column 129 and, eventually, the purity of oxygen product 131. In order to control this oxygen purity, one can implement a liquid or vapor bypass, with the flow control valve, around the entire mass transfer zone, or any portion thereof. In FIG. 2, the embodiment with such a vapor bypass is shown. This bypass, line 241, with flow control valve 243, leads from the sump of column 129 to the waste stream 133.

Figure 3:
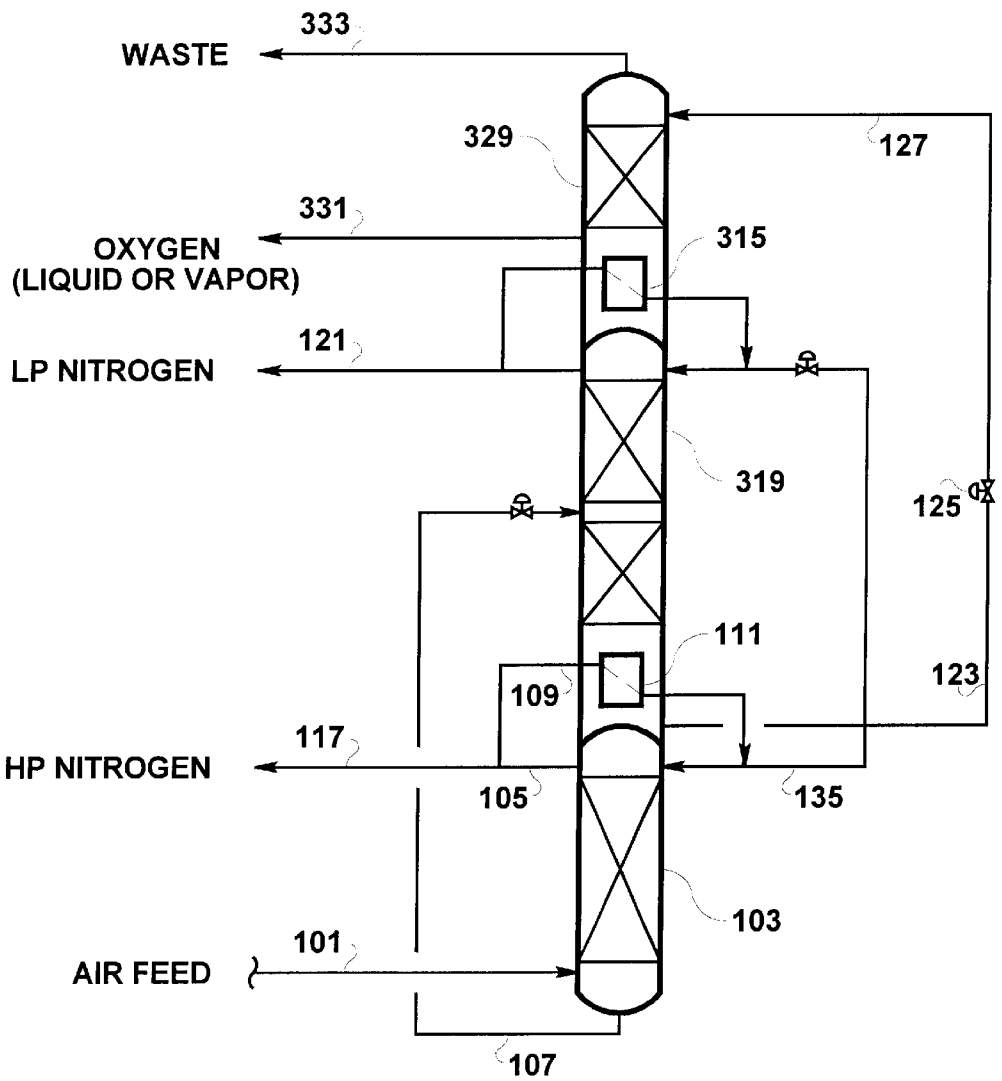

Another embodiment of the present invention is possible where a different heating medium is used to provide the boilup for the supplemental column. Such an embodiment is shown in FIG. 3. The structure of the cycle differs from the previous system of distillation columns in that supplemental stripping column 329 is thermally integrated with lower pressure column 319 through reboiler/condenser 315. In this embodiment, the pressure in lower pressure column 319 must be high enough so that the temperature on top of this column is sufficient to boil oxygen in reboiler/condenser 315.

Figure 4:
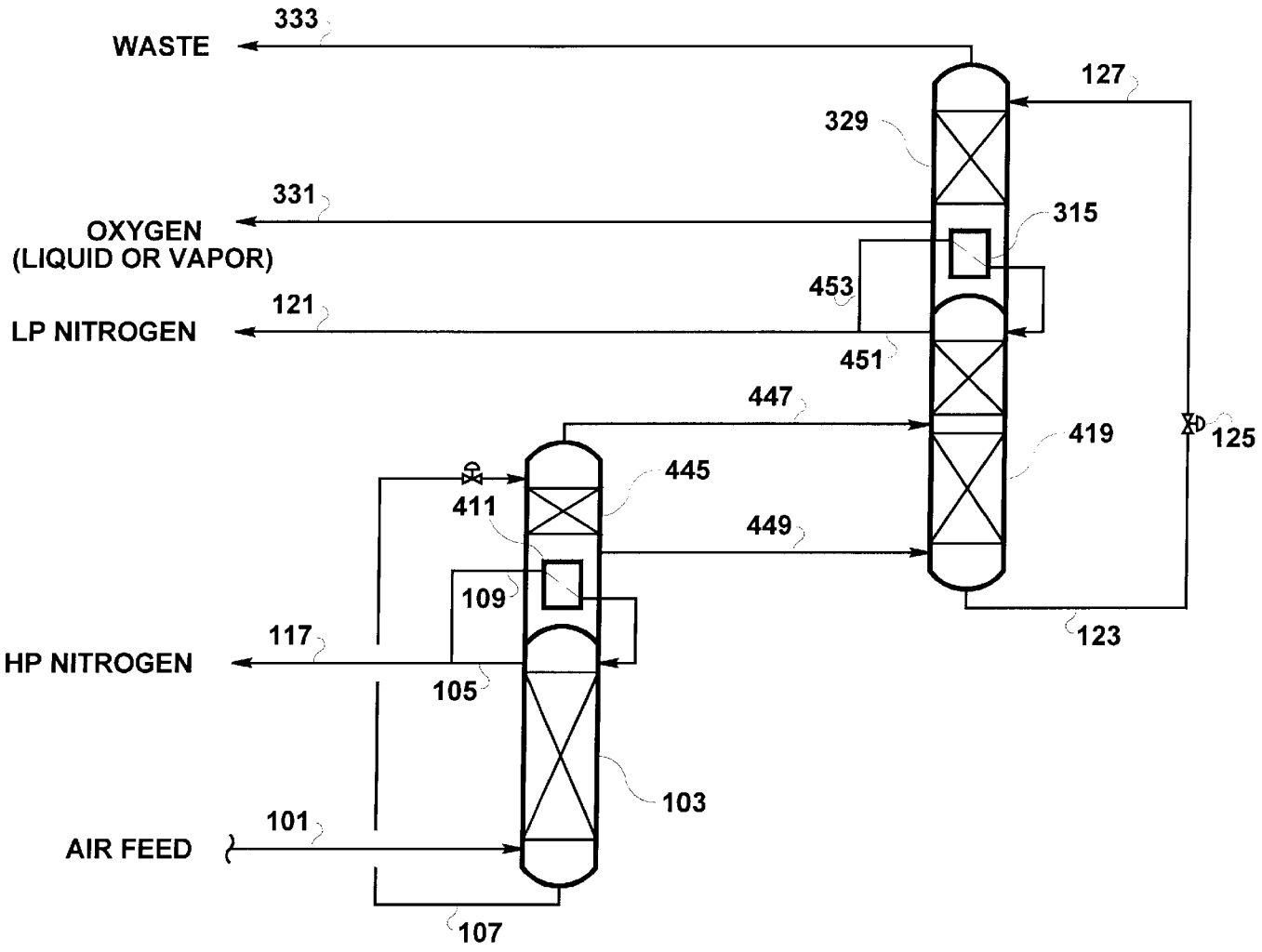

Another embodiment of the present invention is shown in FIG. 4. Feed air 101 is separated in the higher pressure column 103 into nitrogen overhead vapor 105 and first oxygen-enriched liquid 107. A portion of nitrogen overhead vapor in line 109 is condensed in reboiler/condenser 411 and returned to higher pressure column 103 as reflux. Another portion of nitrogen overhead vapor is withdrawn in line 117 as higher pressure nitrogen product. First oxygen-enriched liquid 107 is reduced in pressure across a JT valve and fed to small stripping column 445, where it is separated into two vapor streams of different compositions, lines 447 and 449. The boilup for column 445 is provided by condensing nitrogen 109 in reboiler/condenser 411. The two vapor streams 447 and 449 are fed to lower pressure column 419 at two different locations and are separated there into nitrogen overhead vapor 451 and second oxygen-enriched liquid 123. A portion of nitrogen overhead vapor in line 453 is condensed in reboiler/condenser 315 and returned to lower pressure column 419 as reflux. Another portion of nitrogen overhead vapor in line 121 is withdrawn as lower pressure nitrogen product. Supplemental column 329 is thermally integrated with lower pressure column 419 by means of reboiler/condenser 315. Second oxygen-enriched liquid 123 is decreased in pressure across a JT valve and fed to distillation column 329, where it is separated into oxygen product 331 and waste stream 333.

The embodiments in FIGS. 1–4 indicate that the boilup for the supplemental column can be provided by the latent heat of condensing nitrogen from the top of the high pressure column or by the latent heat of condensing nitrogen from the top of the low pressure column. This particular choice of the heating fluid is not necessary, and one could use any other available and suitable process stream to provide the boilup for the oxygen stripper, for example, a portion of the feed air stream, a vapor stream withdrawn below the top of the higher pressure column, a vapor stream withdrawn below the top of the lower pressure column, sensible heat of the first oxygen-enriched liquid 107. It is also understood that all or some of the nitrogen which is condensed may originate from a location below the top of the applicable column.

Figure 5:
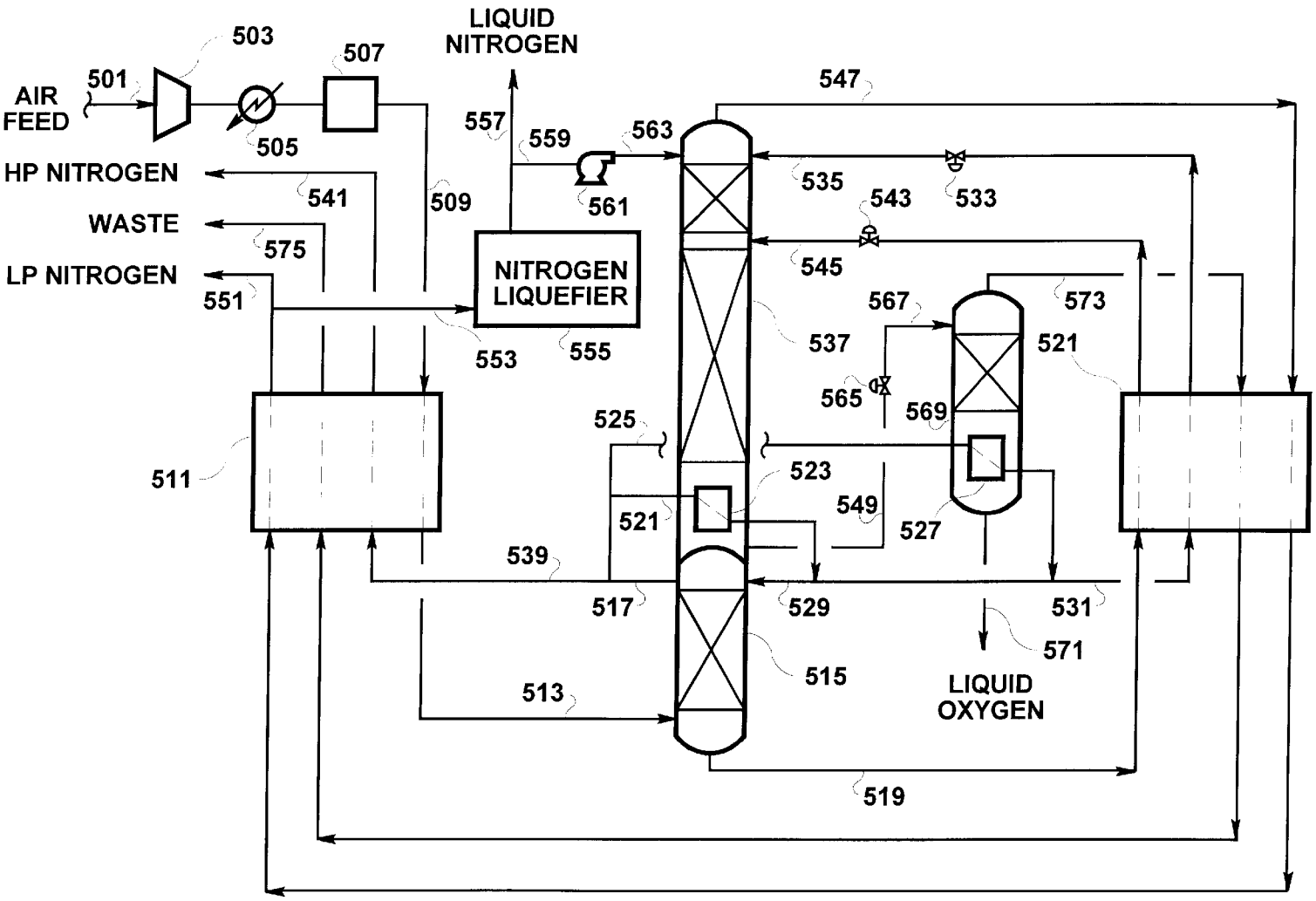

Another of the possible embodiments of the present invention is shown in FIG. 5. The objective of this air separation unit is to produce vapor and liquid nitrogen (at a relatively high recovery), together with a small quantities of liquid oxygen (at a relatively low recovery). In order to produce cryogenic liquids, this cycle has been combined (for the sake of this embodiment) with a nitrogen liquefier. However, in general, any type of a liquefier, e.g., nitrogen liquefier, air liquefier, a hybrid (nitrogen and air) liquefier, containing one or more expansion turbines could be used in this cycle.

In FIG. 5, feed air is supplied in line 501, compressed in main air compressor 503, cooled in heat exchanger 505 against external cooling fluid, treated to remove water and carbon dioxide, preferably, in adsorber 507, introduced, via line 509, to main heat exchanger 511, where it is cooled to a cryogenic temperature and fed, via line 513, to higher pressure distillation column 515. Depending on process specifications the higher pressure column can operate at a pressure range from about 50 psia to about 250 psia, preferably at the range 65 psia to 150 psia. Air is separated in the higher pressure column to produce nitrogen overhead vapor 517 and first oxygen-enriched liquid 519. A portion of the nitrogen overhead vapor in line 521 is condensed in reboiler/condenser 523. A second portion of nitrogen overhead vapor in line 525 is condensed in reboiler/condenser 527. A portion of the liquefied nitrogen is returned as reflux in line 529 to higher pressure column 515, and a second portion in line 531 is subcooled in heat exchanger 521, reduced in pressure across valve 533 and introduced, via line 535, to lower pressure column 537 as reflux. Optionally, a third portion of nitrogen overhead vapor in line 539 can be withdrawn, warmed up in heat exchanger 511 and delivered as higher pressure nitrogen product 541. First oxygen-enriched liquid 519 is subcooled in heat exchanger 521, reduced in pressure across valve 543 and introduced, via line 545, to lower pressure column 537, where it is further separated into lower pressure nitrogen vapor 547 and second oxygen-enriched liquid 549. The lower pressure column can operate at a pressure range from 25 to 100 psia and, preferably, between 25 and 50 psia. Lower pressure nitrogen 547 is warmed up in heat exchangers 521 and 511 and divided into two streams: product stream 551 and liquefier feed stream 553. Optionally, or alternatively, all or a portion of higher pressure nitrogen product in stream 541 can be directed to nitrogen liquefier 555. A portion of nitrogen liquefied in liquefier 555 is withdrawn in line 557 as a product, and another portion, in line 559, is pumped by pump 561 through line 563 to lower pressure column 537 as a supplemental reflux. Second oxygen-enriched liquid 549 is reduced in pressure across JT valve 565 and the resulting fluid in line 567 is distilled in supplemental column 569 to provide liquid oxygen product 571 and waste stream 573. Waste stream 573 is warmed up in heat exchangers 521 and 511 and leaves the system, via line 575. Supplemental column 569 can operate at a pressure close to atmospheric pressure and at a higher pressure, preferably at a range of 15–30 psia.

If liquid is not used for refrigeration, some form of expander refrigeration may be employed. For the embodiment in FIG. 5, one might elect to operate column 569 at an elevated pressure and expand the waste stream 573. Alternatively, one may elect to expand a portion of feed air, preferably, to the pressure of lower pressure column 537. Finally, one may elect to withdraw an oxygen-enriched vapor from the lower pressure column and expand it.

Figure 6:
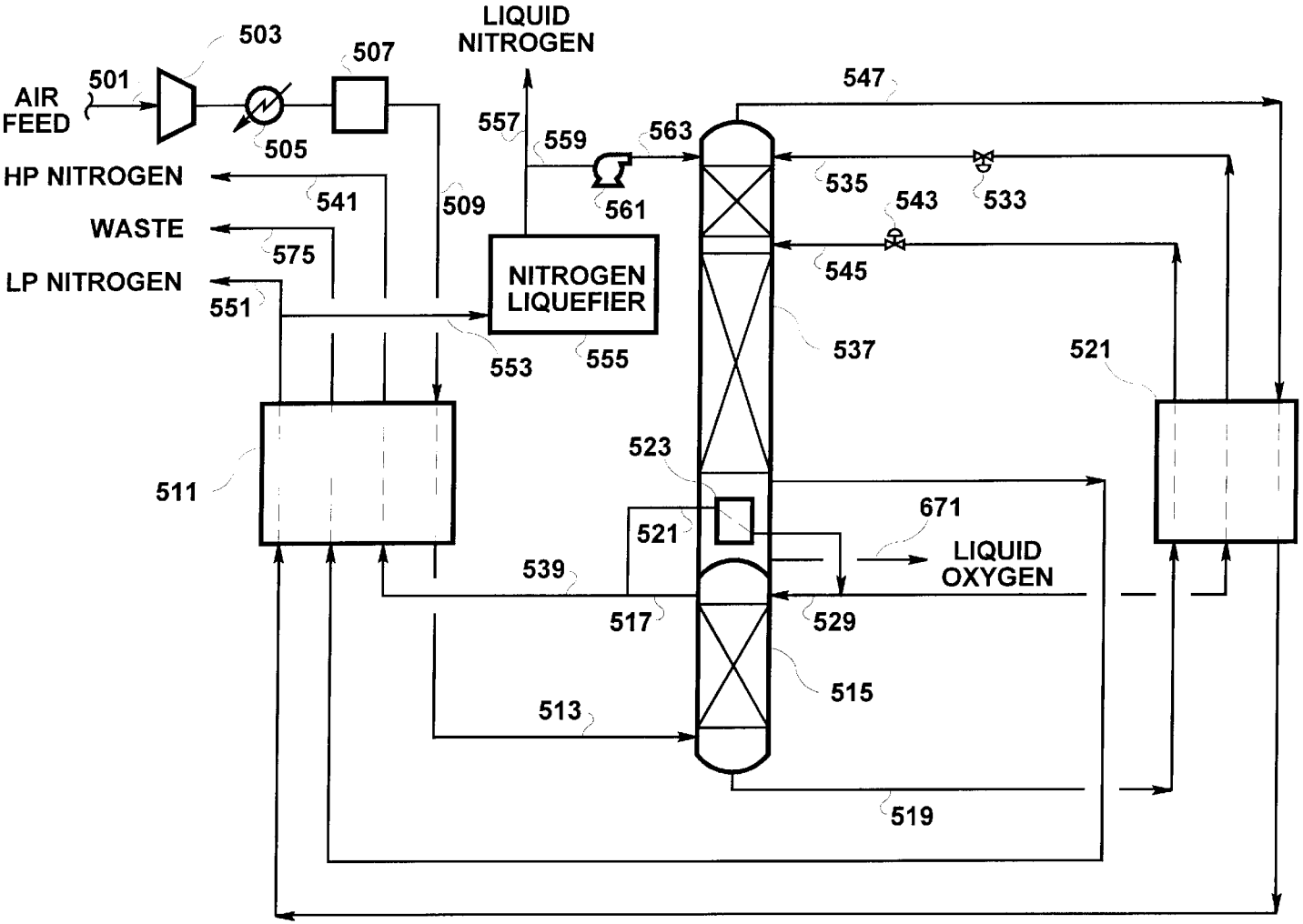
FIG. 6 is a schematic diagram of a background art process.

In order to show the efficacy of the present invention, the embodiment shown in FIG. 5 has been simulated to calculate its power consumption for its comparison to a classic double column cycle with nitrogen liquefier as illustrated in FIG. 6. The comparison has been done assuming a production of 1500 short tons per day of a nitrogen product containing no more than 5 ppm oxygen, which is post-compressed to 150 psia. In addition to this nitrogen, 165 short tons per day of liquid oxygen is produced at an oxygen purity of 99.5%. The power consumption for the present invention as shown in FIG. 5 is 10.2 MW. The power consumption for the classic double column cycle shown in FIG. 6 (where any excess oxygen is vented) is 11.4 MW. As can be seen, the process of the present invention is a more highly efficient process.

Figure 7:
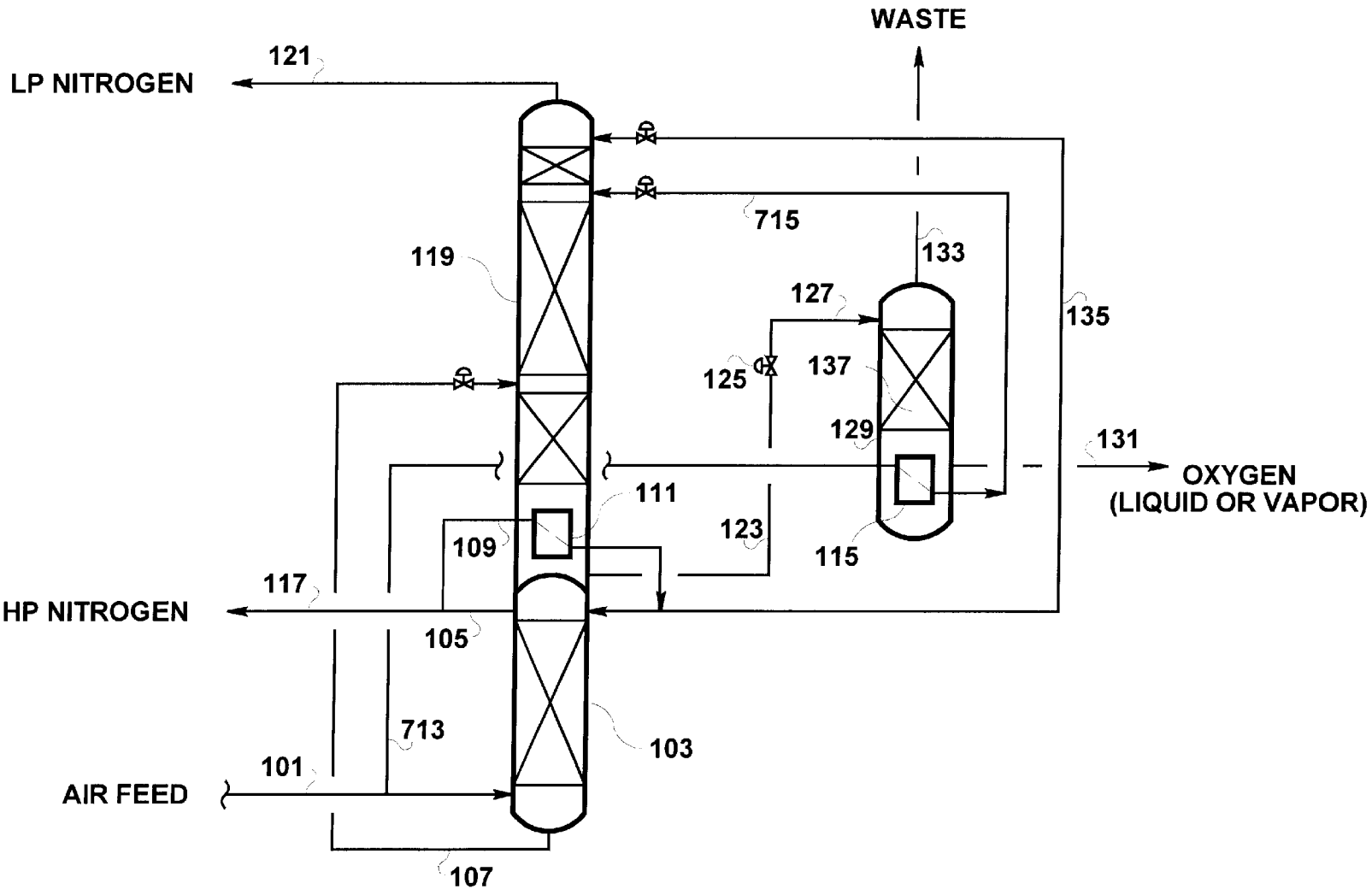
FIGS. 7 through 11 are schematic diagrams illustrating several other embodiments of the invention.
Figure 8:
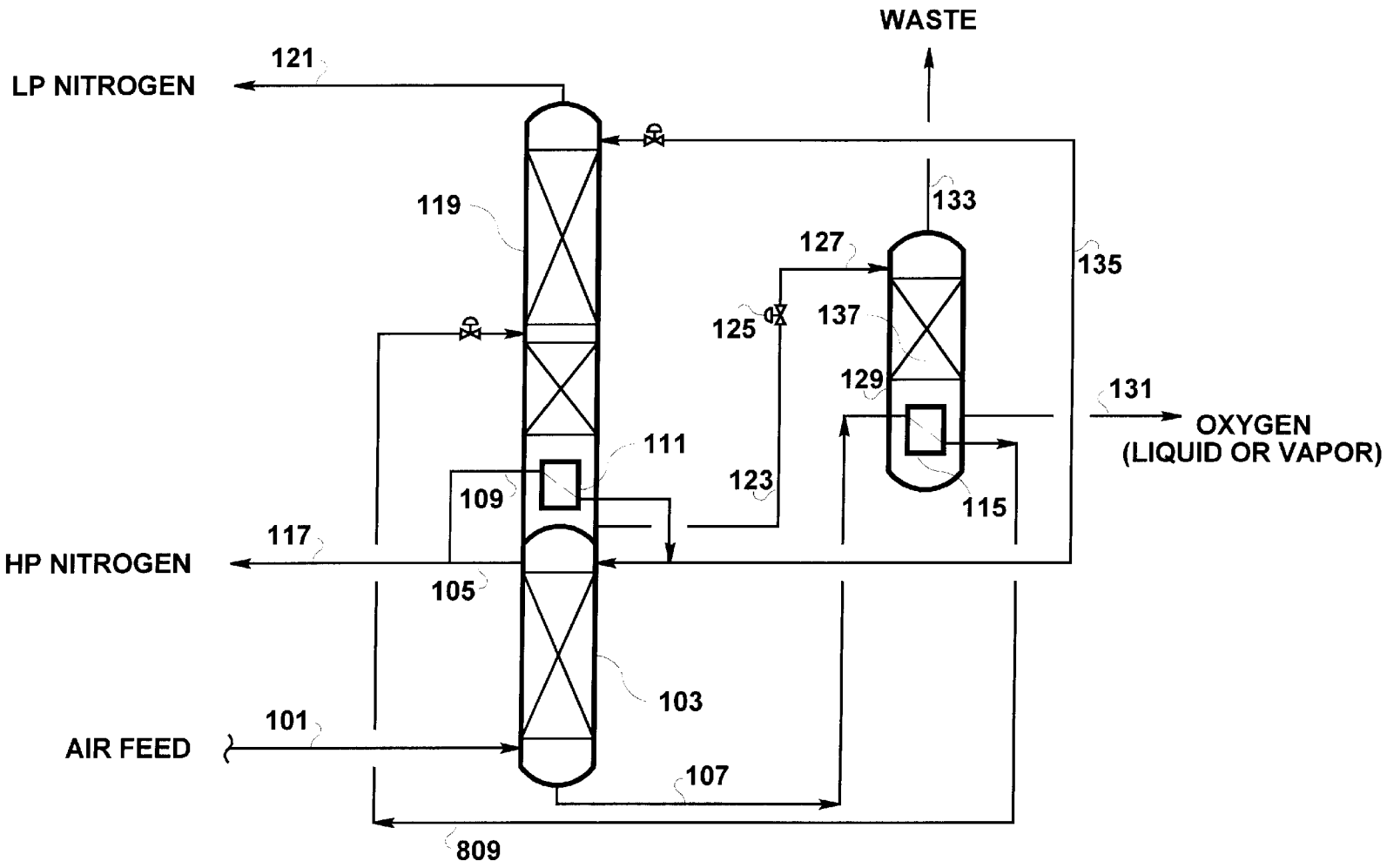
Figure 9:
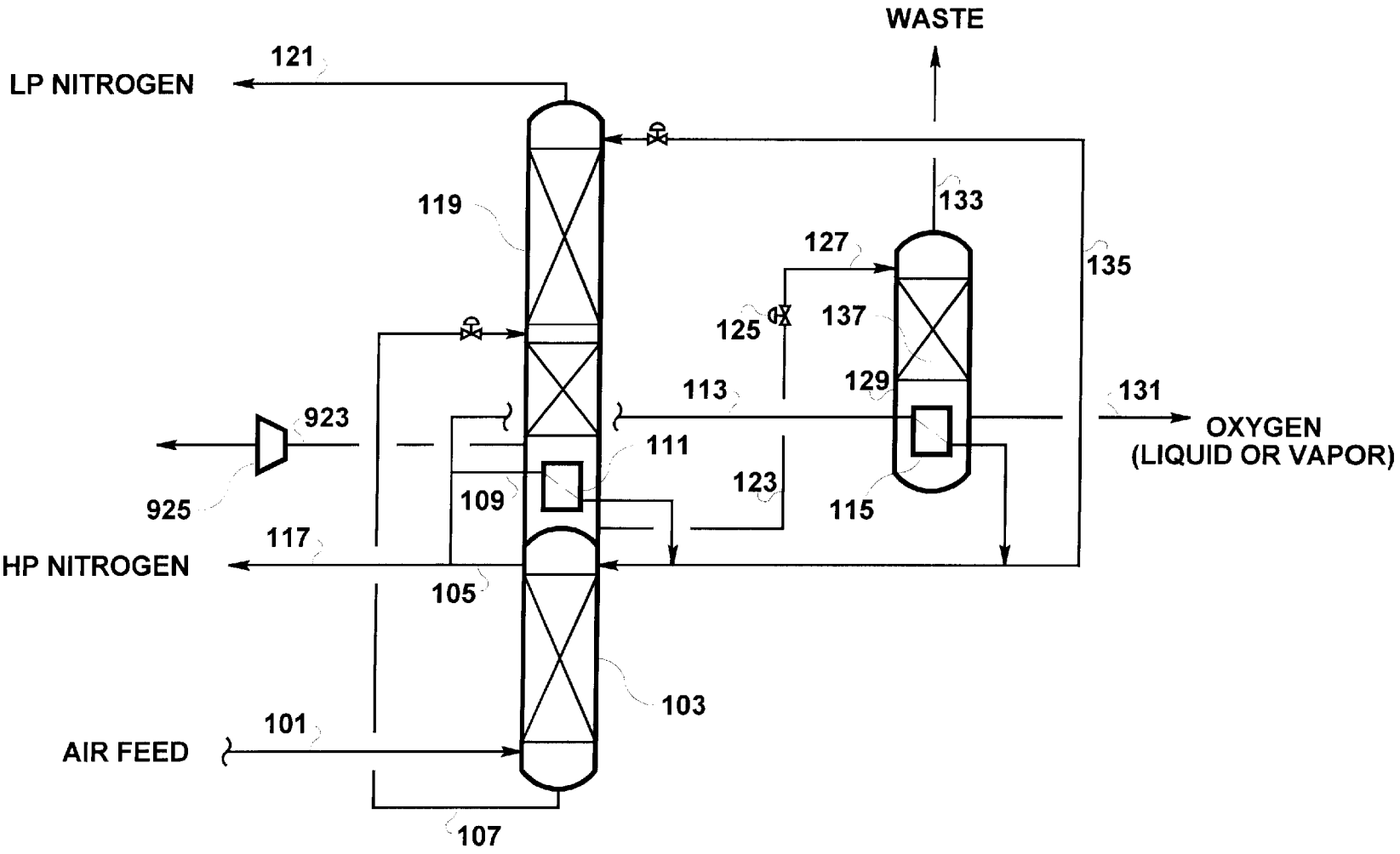
Figure 10:
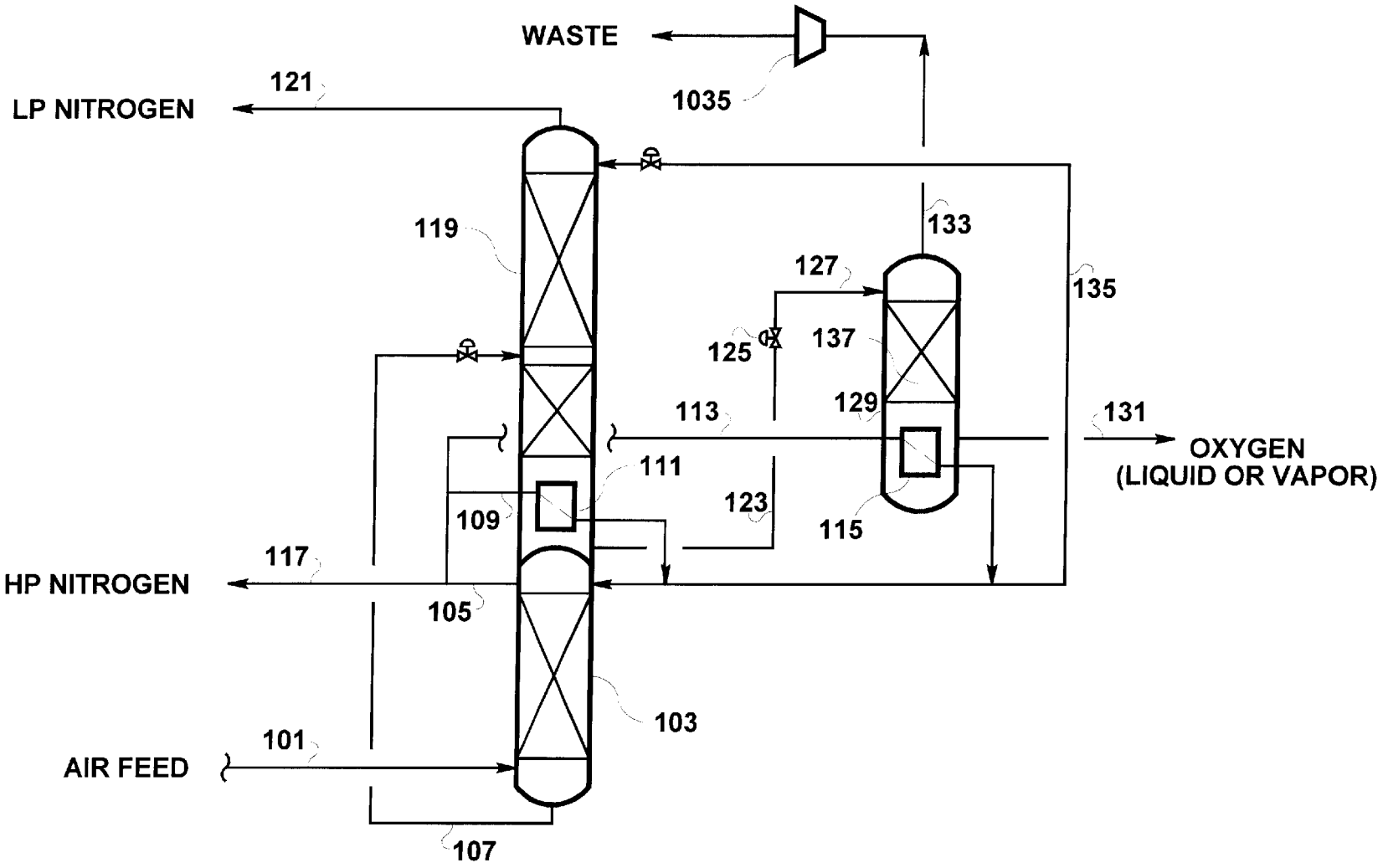
Figure 11:
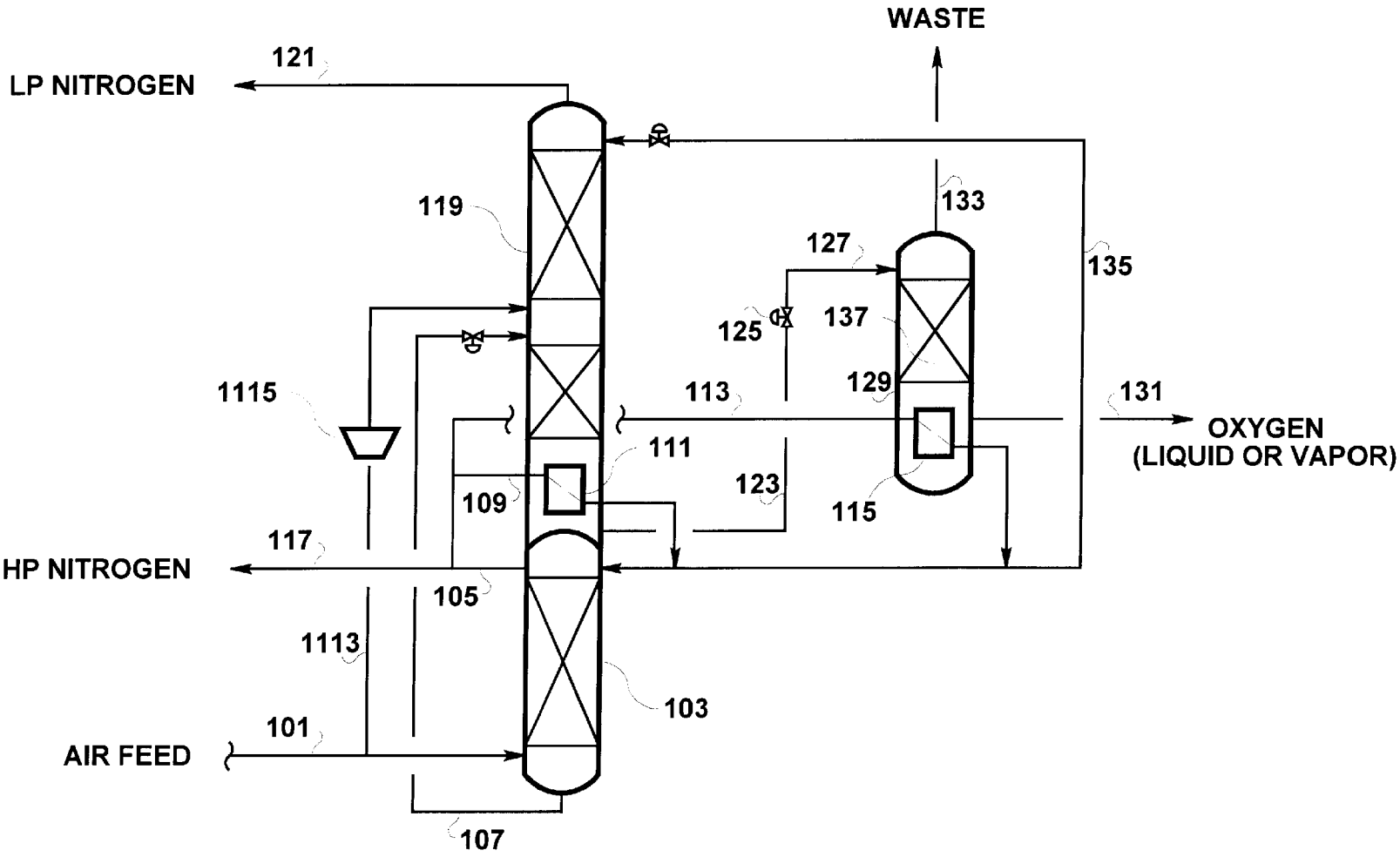

Other embodiments of the present invention are possible. FIG. 7 illustrates how a portion of the air feed (stream 713) may be condensed in reboiler/condenser 115 to provide boilup for supplemental column 129. Alternatively, as shown in FIG. 8, first oxygen-enriched stream 107 may be sensibly cooled in reboiler 115 to Provide the boilup for the supplemental column. FIGS. 9–11 illustrate different means of providing refrigeration for the process. In FIG. 9, an oxygen-enriched vapor is withdrawn from the lower pressure distillation column as stream 923 and turbo-expanded in 925 to provide refrigeration for the process. In FIG. 10, the overhead vapor from the supplemental column, stream 133, may be expanded in 1035 to provide refrigeration. Finally, in FIG. 11, a portion of the feed air (stream 1113) is expanded in 1115 then introduced to the lower pressure column.

The present invention has been described with reference to several specific embodiments thereof. Such embodiments should not be viewed as a limitation on the present invention. The scope of the present invention should be ascertained in accordance with the following claims.

We claim:

1. In a cryogenic process for the distillation of air to produce a nitrogen product in a distillation column system having a higher pressure column and a lower pressure column, wherein feed air is compressed, treated to remove water and carbon dioxide, cooled to near its dew point and fed to the higher pressure column of the distillation column system, wherein the nitrogen product is produced by removing an overhead vapor stream from at least one of the columns of the distillation column system and wherein at least one oxygen-enriched stream is removed from the lower pressure column, characterized in that: (a) the oxygen-enriched stream is a liquid and is removed from the lower pressure column at a location that is below the feed to the lower pressure column; (b) feeding the removed oxygen-enriched liquid stream to the top of a supplemental distillation column for distillative separation into an oxygen bottoms and a waste overhead; (c) providing boilup to the supplemental distillation column, (d) removing an oxygen vapor stream from the bottom of the supplemental distillation column as an oxygen product and (e) operating the supplemental distillation column at pressure which is lower than the pressure of the lower pressure column.

2. The process in claim 1 wherein the boilup for the supplemental distillation column is provided by condensing a portion of a vapor stream from the higher pressure column.

3. The process in claim 1 wherein boilup for the supplemental distillation column is provided by condensing a portion of a vapor stream from the lower pressure distillation column.

4. The process in claim 1 wherein boilup for the supplemental distillation column is provided by condensing a portion of the feed air.

5. The process in claim 1 wherein boilup for the supplemental distillation column is provided by sensible cooling of at least a portion of an oxygen-enriched liquid removed from the distillation column system.

6. The process in claim 1 wherein the supplemental distillation column contains at least one a separation zone in which vapor and liquid are counter-currently contacted, and wherein the ratio of liquid flow to vapor flow in the separation zone is controlled by bypassing, around the separation zone, a portion of the liquid or the vapor which would have entered the portion of the separation zone.

7. The process in claim 1 wherein an oxygen-enriched vapor is withdrawn from the lower pressure distillation column and expanded to provide process refrigeration.

8. The process in claim 1 wherein the waste overhead is removed from the supplemental distillation column and expanded to provide process refrigeration.

9. The process in claim 1 wherein refrigeration for the process is provided by expanding at least a portion of the compressed feed air.

10. The process of claim 1 wherein less than seventy percent (70%) of oxygen in the feed air is recovered in the oxygen product.

11. The process of claim 1 wherein less than fifty five percent (55%) of oxygen in the feed air is recovered in the oxygen product.

12. The process of claim 1 wherein the oxygen product has an oxygen concentration between 85% and 99.99% oxygen.

13. The process of claim 1 wherein the oxygen product has an oxygen concentration between 95% and 99.7% oxygen.

14. The process of claim 1 wherein the oxygen-enriched stream removed from the lower pressure column is a liquid.

15. The process of claim 14 wherein the oxygen-enriched stream is removed from the bottom of the lower pressure column.

* * * * *